US012673362B2

(12) United States Patent
Imahase et al.

(10) Patent No.: US 12,673,362 B2
(45) Date of Patent: Jul. 7, 2026

(54) SLIDING NOZZLE DEVICE

(71) Applicant: KROSAKIHARIMA CORPORATION, Fukuoka (JP)

(72) Inventors: Toshihiro Imahase, Fukuoka (JP); Mamoru Yoshimura, Fukuoka (JP); Yusuke Yamaguchi, Fukuoka (JP); Yudai Onoue, Fukuoka (JP)

(73) Assignee: KROSAKIHARIMA CORPORATION, Fukuoka (JP)

( * ) Notice: Subject to any disclaimer, the term of this patent is extended or adjusted under 35 U.S.C. 154(b) by 361 days.

(21) Appl. No.: 18/275,844

(22) PCT Filed: Jan. 28, 2022

(86) PCT No.: PCT/JP2022/003331

§ 371 (c)(1),
(2) Date: Aug. 4, 2023

(87) PCT Pub. No.: WO2022/168753

PCT Pub. Date: Aug. 11, 2022

(65) Prior Publication Data

US 2024/0116102 A1 Apr. 11, 2024

(30) Foreign Application Priority Data

Feb. 4, 2021 (JP) ..... 2021-016813

(51) Int. Cl.
*B22D 41/34* (2006.01)

(52) U.S. Cl.
CPC ..... *B22D 41/34* (2013.01)

(58) Field of Classification Search
CPC ..... B22D 41/34; B22D 41/30; B22D 41/38; B22D 41/24; F27D 3/14
(Continued)

(56) References Cited

U.S. PATENT DOCUMENTS 5,242,014 A * 9/1993 Takahashi ..... B22D 11/16 164/451
8,498,740 B2 * 7/2013 Truttmann ..... B22D 41/22 222/597

(Continued)

FOREIGN PATENT DOCUMENTS

CN 212443237 U 2/2021
JP 8-168862 A 7/1996

(Continued)

OTHER PUBLICATIONS

International Search Report with Written Opinion, for PCT/JP2022/003331 filed Jan. 28, 2022.

(Continued)

*Primary Examiner* — Jessee R Roe
*Assistant Examiner* — Michael Aboagye
(74) *Attorney, Agent, or Firm* — Fleit Intellectual Property Law; Paul D. Bianco

(57) ABSTRACT

A sliding nozzle device capable of allowing a maintenance robot to reliably and accurately recognize the position thereof. The sliding nozzle device includes: a fixed metal frame; and a sliding metal frame slidably provided to the fixed metal frame. The fixed metal frame is provided with a mark block for allowing a maintenance robot to recognize the position thereof. More specifically, the mark block is provided to protrude from a side surface or bottom surface of the fixed metal frame toward the sliding metal frame, at a position free from interference with the sliding metal frame during sliding.

2 Claims, 12 Drawing Sheets

(58) Field of Classification Search
USPC ..... 266/236; 222/597, 591, 600; 164/412
See application file for complete search history.

(56) References Cited

U.S. PATENT DOCUMENTS

| | | | | |
|---|---|---|---|---|
| 11,938,534 | B2 * | 3/2024 | Yoshimura | B25J 13/08 |
| 11,958,106 | B2 * | 4/2024 | Yoshimura | B22D 41/24 |
| 12,115,578 | B2 * | 10/2024 | Carosielli | B22D 41/38 |
| 2022/0097129 | A1 | 3/2022 | Yoshimura | |

FOREIGN PATENT DOCUMENTS

| | | | |
|---|---|---|---|
| JP | 2011-25261 | A | 2/2011 |
| JP | 2020-142247 | A | 9/2020 |
| JP | 2021-000643 | A | 1/2021 |
| WO | 2020/179774 | A1 | 9/2020 |

OTHER PUBLICATIONS

International Preliminary Report on Patentability dated Aug. 3, 2023 for PCT/JP2022/003331, filed Jan. 28, 2022.

* cited by examiner

Fig. 5A
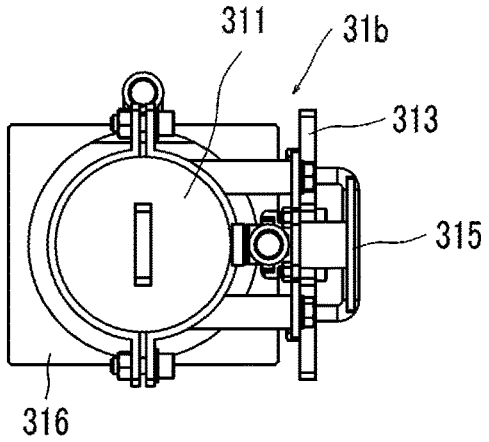
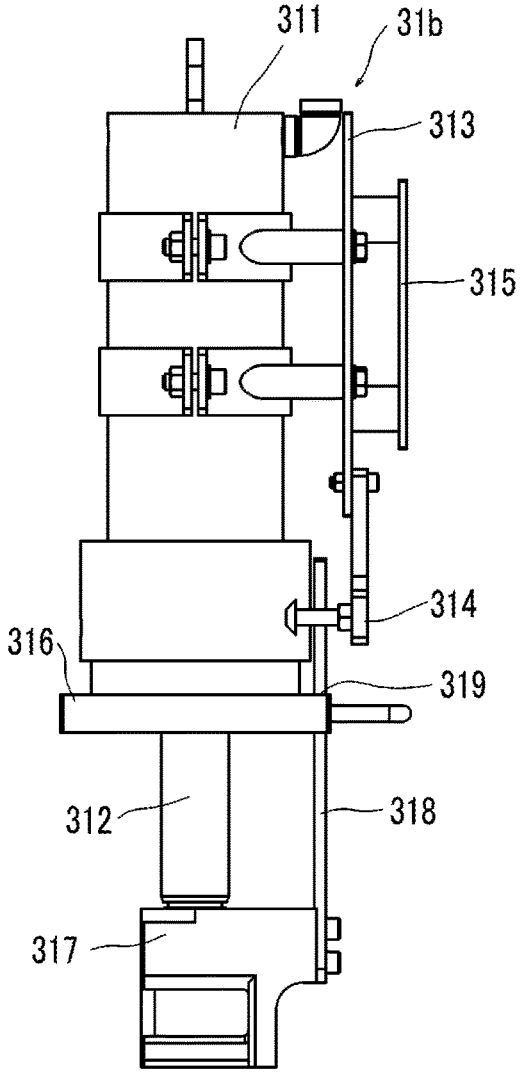
Fig. 5B
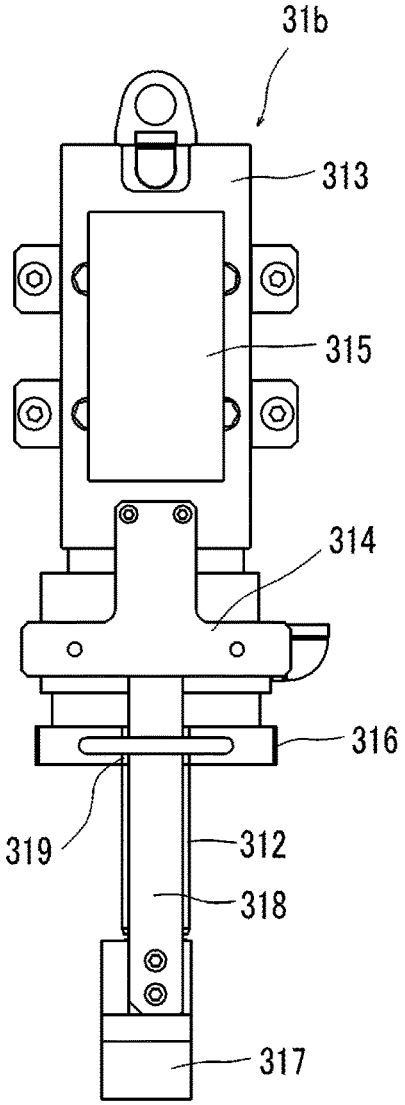
Fig. 5C

Fig. 7A
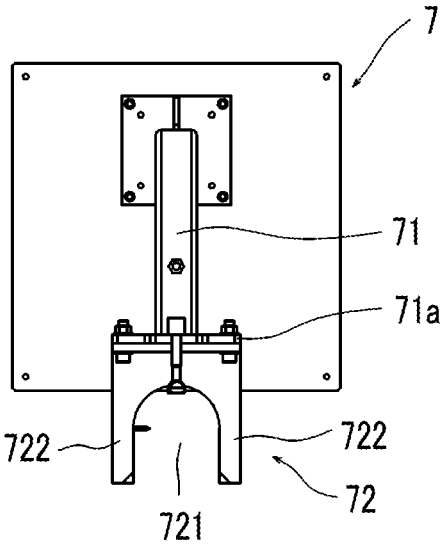
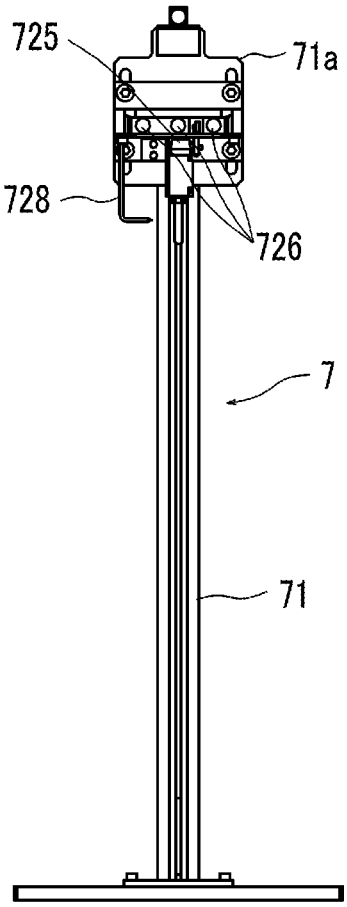
Fig. 7B
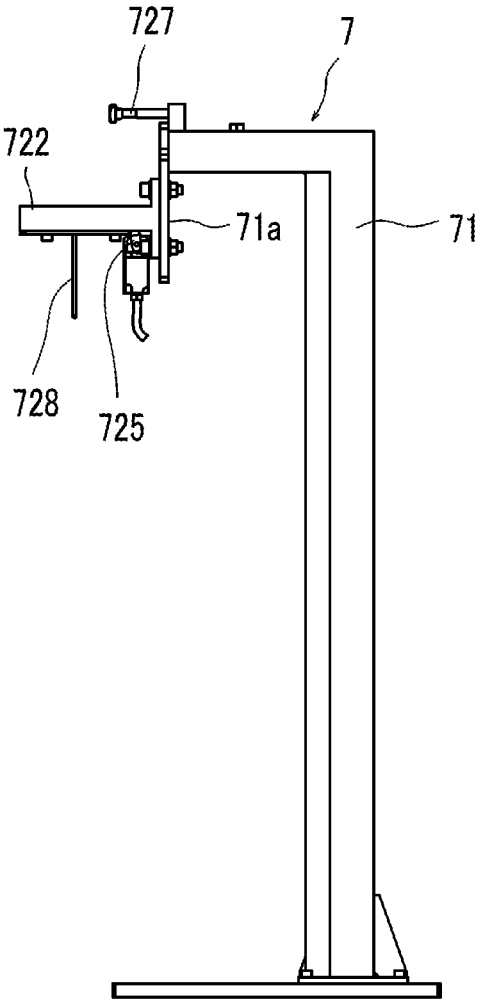
Fig. 7C

SLIDING NOZZLE DEVICE

TECHNICAL FIELD

The present invention relates to a sliding nozzle device.

BACKGROUND ART

A molten steel vessel such as a ladle or a tundish is provided, at the bottom thereof, with a sliding nozzle device for adjusting the flow rate of molten steel flowing out from the molten steel vessel.

In the event of maintenance of the sliding nozzle device, the maintenance is conducted by placing the molten steel vessel in a maintenance site. However, since the molten steel vessel is large in size, the position of the sliding nozzle device in the maintenance site varies widely in every maintenance. Thus, in order to conduct the maintenance of the sliding nozzle device using a maintenance robot, it is necessary to allow the maintenance robot to reliably and accurately recognize the position of the sliding nozzle device.

In this regard, the following Patent Document 1 discloses that the position of a sliding nozzle device is recognized by taking an image of an imaging reference part (image-acquisition reference area) of the sliding nozzle device by a camera (paragraph [0010] of the Patent Document 1), but does not disclose a specific position or the like of the imaging reference part.

CITATION LIST

Patent Document

Patent Document 1: JP-A 2020-142247

SUMMARY OF INVENTION

Technical Problem

A technical problem to be solved by the present invention is to provide a sliding nozzle device capable of allowing a maintenance robot to reliably and accurately recognize the position there.

Solution to Technical Problem

The present invention provides a sliding nozzle device having the following features.

1. A sliding nozzle device comprising: a fixed metal frame; and a sliding metal frame slidably provided to the fixed metal frame, wherein the fixed metal frame is provided with a mark block for allowing a maintenance robot to recognize a position thereof, the mark block being provided to protrude from a side surface or bottom surface of the fixed metal frame toward the sliding metal frame, at a position free from interference with the sliding metal frame during sliding.
2. The sliding nozzle device as forth in the section 1, which is configured to during use, slide the sliding metal frame within a first sliding range under a condition that a surface pressure is loaded between the fixed metal frame and the sliding metal frame, and during maintenance, slide the sliding metal frame to an outside of the first sliding range, thereby unloading the surface pressure, wherein the mark block is positioned such that it is covered by the sliding metal frame or a shielding plate provided to the sliding metal frame, when the sliding metal frame is slid within the first sliding range, but not covered by the sliding metal frame or the shielding plate, when the sliding metal frame is slid to the outside of the first sliding range.

Effect of Invention

The sliding nozzle device according to the present invention makes it possible to allow a maintenance robot to reliably and accurately recognize the position thereof.

BRIEF DESCRIPTION OF DRAWINGS

FIGS. 5A-5C illustrate a drive unit, wherein FIG. 5A, FIG. 5B, and FIG. 5C are a top plan view, a front view, and a right side view, respectively.

FIG. 6A is a fragmentary perspective view of the stand.

FIGS. 7A-7C illustrate the stand, wherein FIG. 7A, FIG. 7B, and FIG. 7C are a top plan view, a front view, and a right side view, respectively.

DESCRIPTION OF EMBODIMENTS

Figure 1:
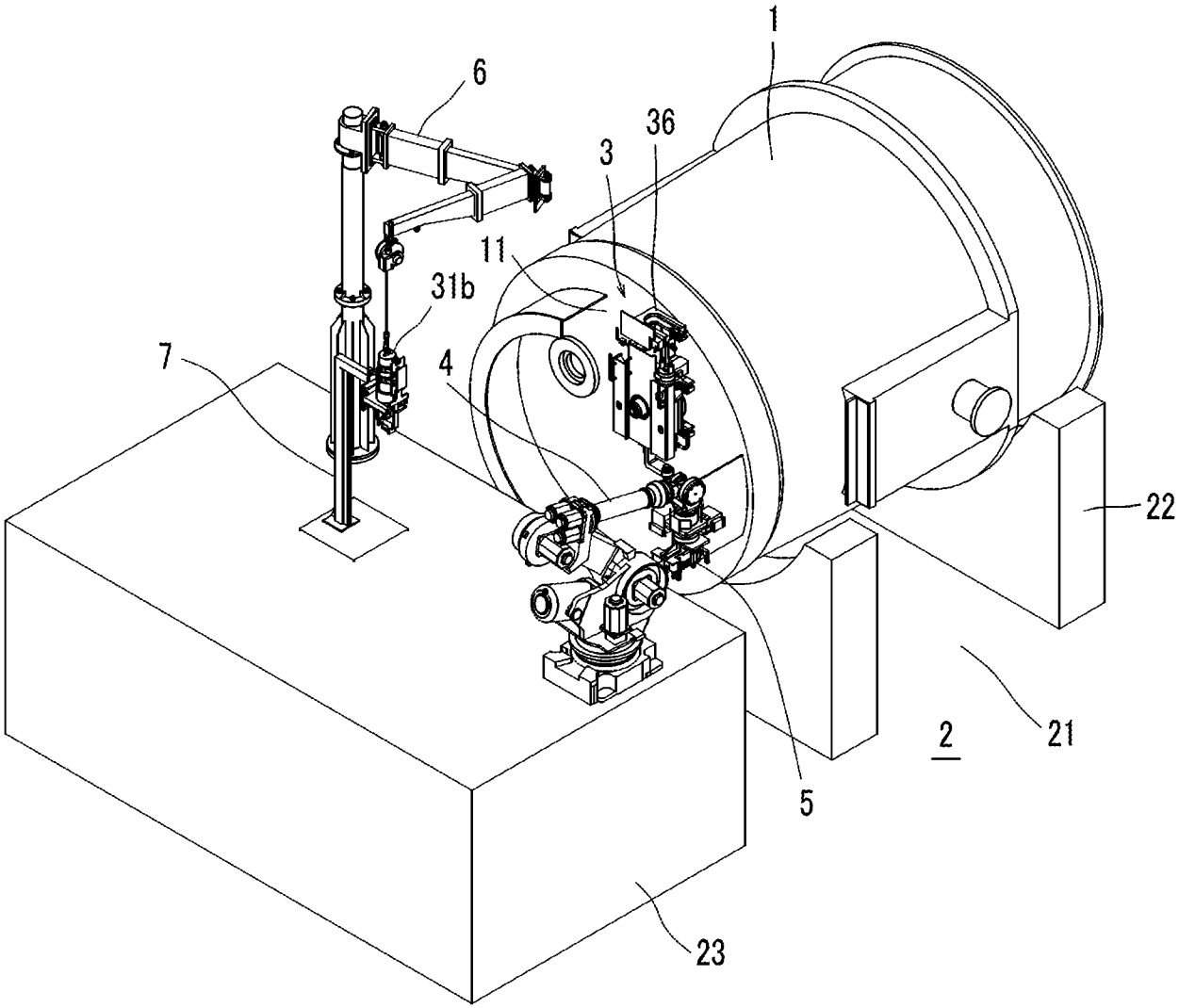
FIG. 1 is an explanatory diagram showing a maintenance site equipped with a mounting device according to one embodiment of the present invention.

FIG. 1 shows a maintenance site equipped with a mounting device according to one embodiment of the present invention.

In FIG. 1, a ladle 1 shortly after completion of casting is laid down on a ladle cradle 22 installed on a floor 21 of the maintenance site 2. This ladle is provided with a sliding nozzle device 3 which is mounted to the bottom 11 thereof. In FIG. 1 showing a state during maintenance, the ladle is positioned such that a sliding direction of the after-mentioned sliding metal frame extends approximately vertically. On the other hand, a robot arm 4 which is one example of a manipulator is provided such that a base end thereof is fixed to a pedestal 23 installed on the floor 21. Then, a mounting device 5 is mounted to a distal end of the robot arm 4 with bolts. A method to mount the mounting device 5 to the robot arm 4 is not limited to bolt fixation, but the mounting device 5 may be mounted to the robot arm 4 by means of two hand changer adaptors mounted to the robot arm 4 and the mounting device 5, respectively.

In this embodiment, this robot arm 4 is a 6-axis vertical articulated robot arm. Thus, it is possible to freely move the posture and position of the mounting device 5 mounted at the distal end of the robot arm 4.

In this specification, the embodiment will be described by taking a hydraulic cylinder 31*b* as an example of a drive unit. It is to be understood that the drive unit is not limited to the hydraulic cylinder 31*b* but any other type of drive unit such as an electric motor may be used, as long as it is capable of sliding the after-mentioned sliding metal frame 33.

A suspending device 6 is also installed on the pedestal 23 to suspend the hydraulic cylinder 31*b* to be mounted to the sliding nozzle device 3 during maintenance. That is, the hydraulic cylinder 31*b* to be mounted to the sliding nozzle device 3 in the maintenance site 2 is in a so-called handing state in which an upper end thereof is connected to the suspending device 6. In this embodiment, the suspending device 6 comprises a balancing mechanism.

A stand 7 is further installed on the pedestal 23 to allow the hydraulic cylinder 31*b* being in the hanging state to be loaded thereon.

Figure 2A:
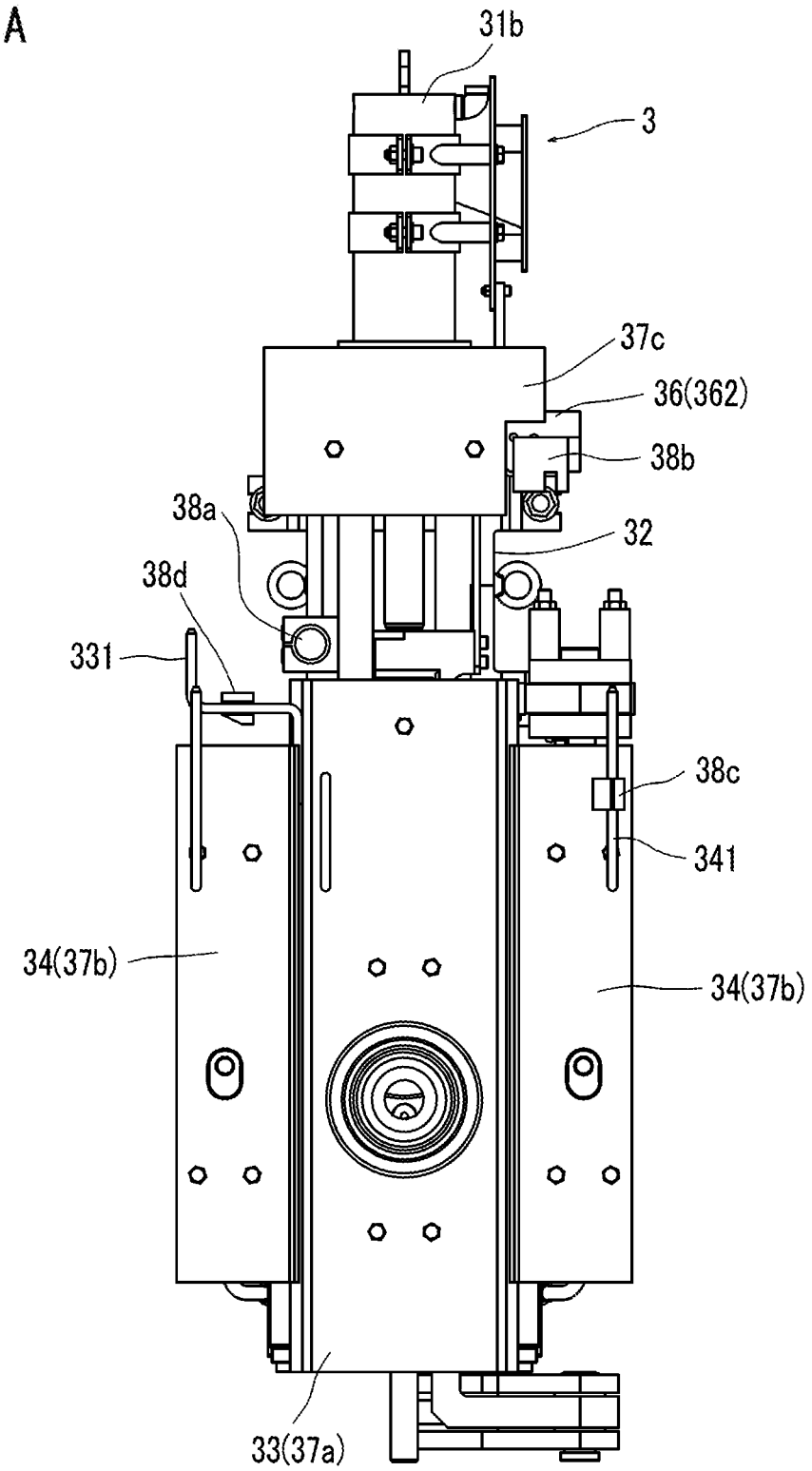
FIG. 2A is an explanatory diagram showing a sliding nozzle device in a state in which a sliding metal frame is closed during maintenance.
Figure 2B:
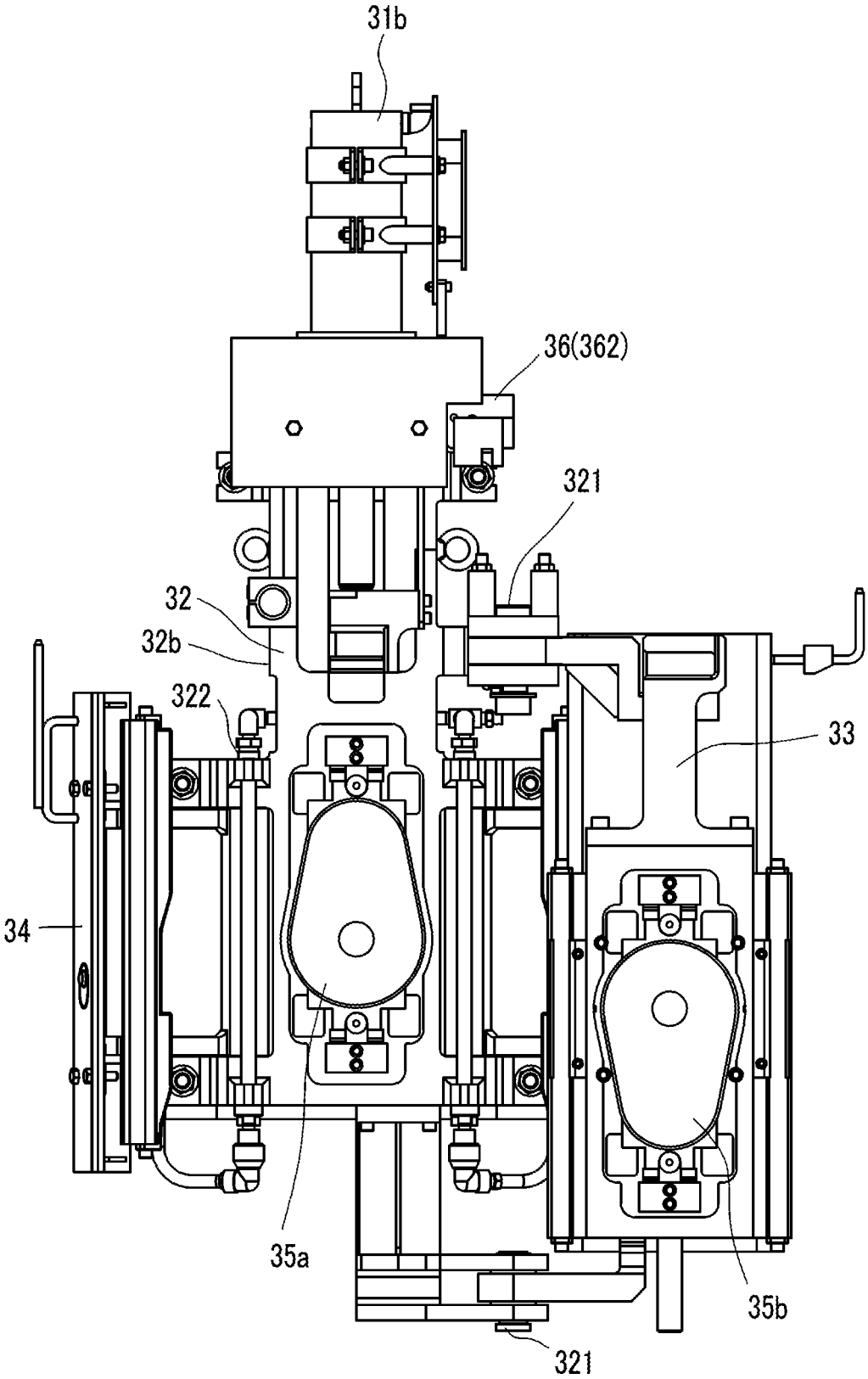
FIG. 2B is an explanatory diagram showing the sliding nozzle device in a state in which the sliding metal frame is opened during maintenance.
Figure 2C:
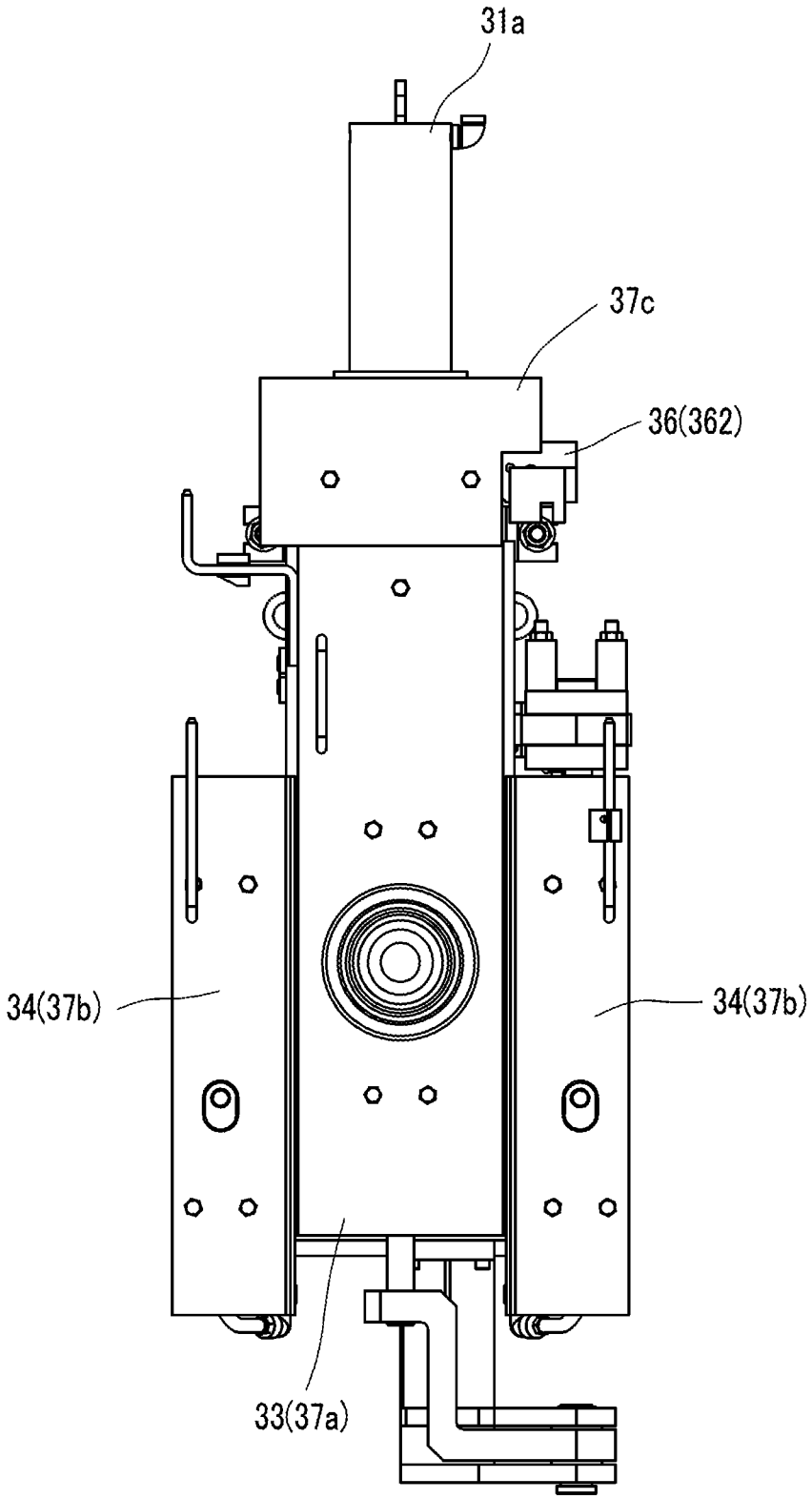
FIG. 2C is an explanatory diagram showing the sliding nozzle device during use.

FIG. 2A illustrates the sliding nozzle device 3 in a state in which the after-mentioned sliding metal frame is closed during maintenance, and FIG. 2B illustrates the sliding nozzle device 3 in a state in which the after-mentioned sliding metal frame is opened during maintenance. Further, FIG. 2C illustrates the sliding nozzle device during use. It should be noted here that although the sliding nozzle device 3 is disposed during use, such that the sliding direction of the after-mentioned sliding metal frame extends horizontally, the sliding nozzle device 3 in FIG. 2C is illustrated such that the sliding direction of the after-mentioned sliding metal frame extends approximately vertically, for facilitating comparison with FIGS. 2A and 2B each showing the state during maintenance.

In this specification, the term "during use of a sliding nozzle device" is defined as "during a period during which casting is performed using the sliding nozzle device." Further, the term "during maintenance" is defined as "during a period during which a ladle is moved to a maintenance site to perform maintenance on a sliding nozzle device mounted to the ladle".

The sliding nozzle device 3 comprises a fixed metal frame 32, a sliding metal frame 33, and two spring boxes 34. An upper plate 35*a* and a lower plate 35*b* are received in the fixed metal frame 32 and the sliding metal frame 33, respectively. The sliding metal frame 33 is provided such that it is slidable with respect to the fixed metal frame 32. Further, the sliding metal frame 33 is provided such that it is rotated about a rotary shaft 321 so as to be opened and closed respect to the fixed metal frame 32. Each of the spring boxes 34 is provided such that it is rotated about a rotary shaft 322 so as to be opened and closed respect to the fixed metal frame 32. The spring boxes 34 are provided on both sides of the fixed metal frame 32, respectively. In a state in which the sliding metal frame 33 is closed by the spring boxes 34, the spring boxes 34 load a surface pressure between the fixed metal frame 32 and the sliding metal frame 33. The spring boxes 34 also load a surface pressure between the upper plate 35*a* and the lower plate 35*b*.

During use, a hydraulic cylinder 31*a* is mounted to the sliding nozzle device 3. On the other hand, during maintenance, the hydraulic cylinder 31*b* is mounted thereto. Specifically, during use, the hydraulic cylinder 31*a* is used to slide the sliding metal frame 33 within a first sliding range under the condition that a surface pressure is loaded between the fixed metal frame 32 and the sliding metal frame 33. On the other hand, during maintenance, the hydraulic cylinder 31*b* is used to slide the sliding metal frame 33 to the outside of the first sliding range, thereby unloading the surface pressure. The hydraulic cylinder 31*a* for use during use is mounted/demounted in a casting site, and the hydraulic cylinder 31*b* for use during maintenance is mounted/demounted in the maintenance site 2 in FIG. 1. This embodiment will be described about the latter case where the hydraulic cylinder 31*b* for use during maintenance is mounted/demounted in the maintenance site 2.

Figure 3:
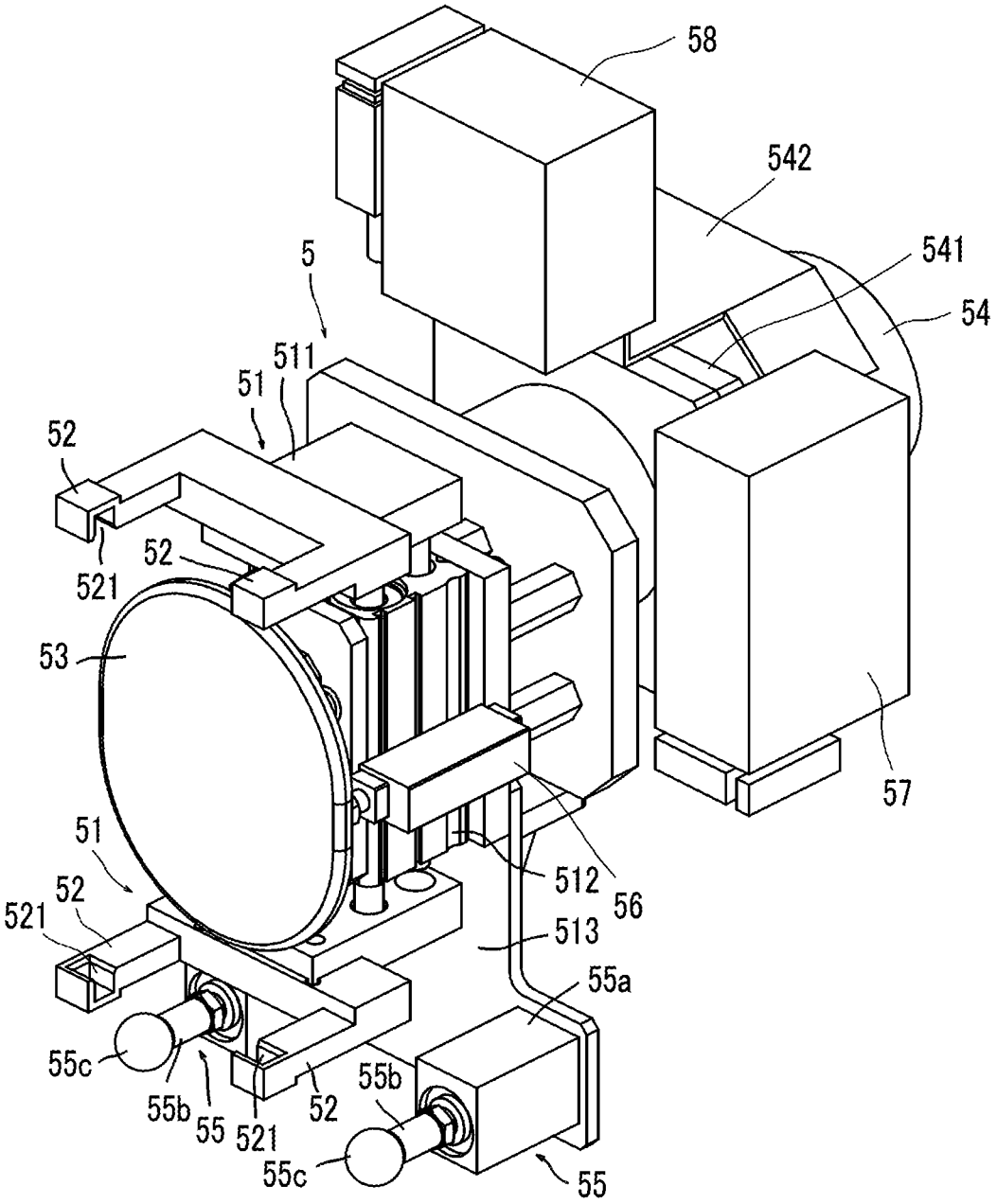
FIG. 3 is a perspective view of the mounting device.
Figure 4:
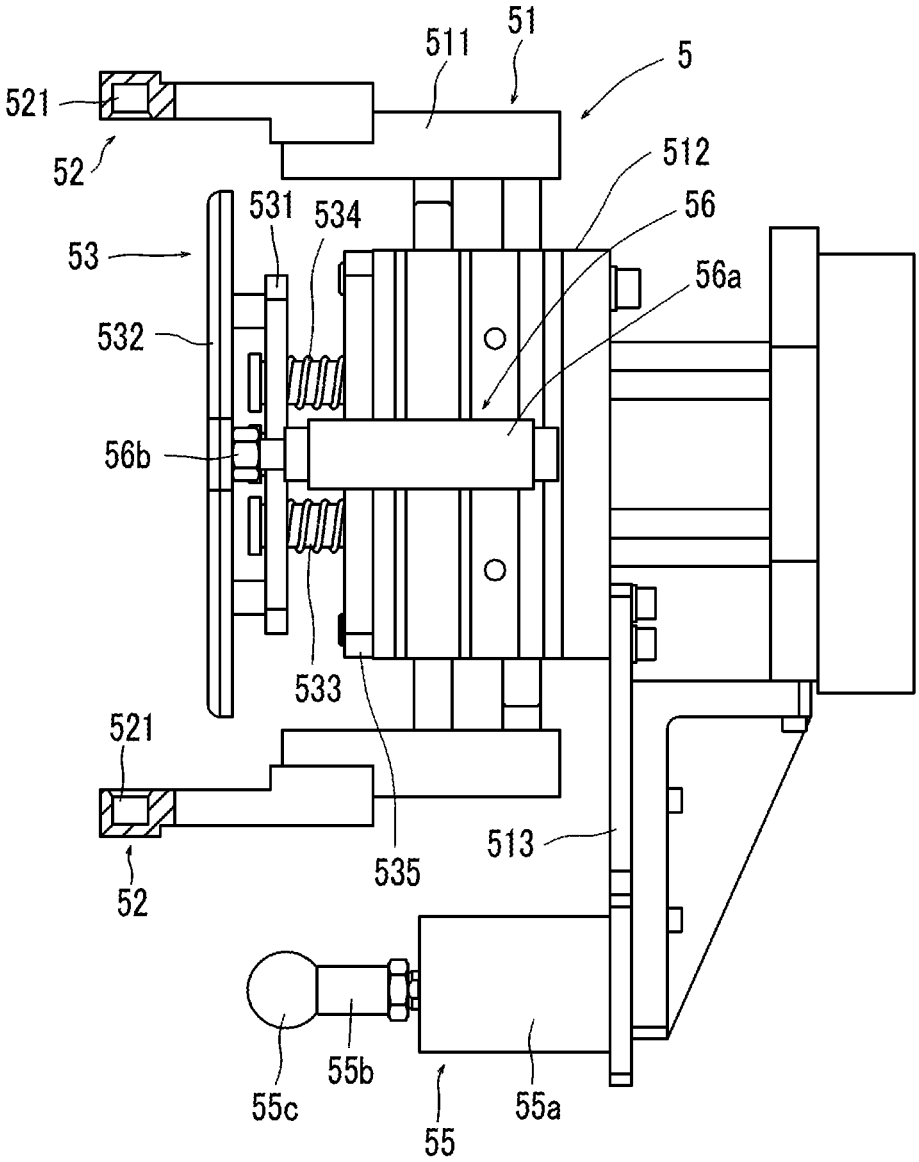
FIG. 4 is a side view of the mounting device (wherein only a holding part is shown in section).

FIGS. 3 and 4 illustrate the mounting device 5 for mounting/demounting the hydraulic cylinder 31*b* for use during maintenance, in this embodiment. FIG. 3 is a perspective view of the mounting device 5, and FIG. 4 is a side view of the mounting device 5.

This mounting device 5 comprises: a device body 512; two parallel hands 51 provided just above and below the device body 512, respectively; a pushing part 53 provide in front of the device body; a force sensor 54; a pressing mechanism 55; a vibration mechanism 56; a laser irradiator 57, and a camera 58.

The positions of the laser irradiator 57 and the camera 58 are not limited to those in this embodiment, but may be reversed. Alternatively, the laser irradiator 57 and the camera 58 may be arranged collectively in one location. The camera 58 is configured to take an image of a component of the sliding nozzle device and take an image of leaser light emitted from the laser irradiator 57.

In this embodiment, the two parallel hands 51 are provided just above and below the device body 512, respectively.

Alternatively, the parallel hands 51 may be configured such that they are provided, respectively, on the right and left sides of the device body 512.

The parallel hands 51 may be configured to be moved by widening-narrowing means which is a non-illustrated power unit, to controllably increase or reduce an up-down directional distance between the parallel hands 51. Examples of this widening-narrowing means include a hydraulic cylinder, an air cylinder, and an electromagnetic chuck. For example, the widening-narrowing means is provided in the device body 512.

In this specification, the behavior of the parallel hands 51 causing an increase in the distance therebetween is expressed as widening of the parallel hands 51, and the behavior of the parallel hands 51 causing a decrease in the distance therebetween is expressed as narrowing of the parallel hands 51.

Each of the parallel hands 51 has a U shape, and comprises a pair of parallel claws 511, and a pair of holding parts 52 each provided at a respective one of distal ends of the pair of parallel claws 511.

It should be noted that FIG. 4 is illustrated by omitting illustration of the force sensor 54, the leaser irradiator 57 and the camera 58.

The detailed configuration of each component of the mounting device 5 will be described later.

FIGS. 5A-5C illustrate the hydraulic cylinder 31*b*, wherein FIG. 5A, FIG. 5B, and FIG. 5C are a top plan view, a front view and a right side view, respectively.

The hydraulic cylinder 31*b* comprises a cylinder body 311, and a cylinder rod 312 configured to be moved forwardly and backwardly with respect to the cylinder body 311. A rectangular-shaped to-be-held plate 313 is mounted to the cylinder body 311. This to-be-held plate 313 can be held by the two pairs of (four) holding parts 52 of the mounting device 5. Specifically, the to-be-held plate 313 is mounted to an area from a central portion to an upper portion of the hydraulic cylinder 31*b*. The two pairs of holding parts 52 of the mounting device 5 clamp the to-be-held plate 313 from thereabove and therebelow, and thereby hold the hydraulic cylinder 31*b*. It is to be understood that the shape of the to-be-held plate 313 is not limited to a rectangular shape, but may be any other suitable shape as long as it can be held by the holding parts 52. Further, the two pairs of holding parts 52 of the mounting device 5 may be configured to clamp the to-be-held plate 313 from the right and left sides thereof.

A to-be-contacted part 314 is mounted to a lower portion of the to-be-held plate 313 such that it extends downwardly from the to-be-held plate 313. This to-be-contacted part 314 is configured and disposed such that the after-mentioned contact part 55*c* provided at a distal end of the pressing mechanism 55 of the mounting device 5 is contactable therewith, as mentioned later. That is, when mounting the hydraulic cylinder 31*b* to a holder 36 (see FIG. 1) of the sliding nozzle device 3, the after-mentioned contact part 55*c* can come into contact with the to-be-contacted part 314 which is a lower portion of the hydraulic cylinder 31*b*.

Further, a to-be-pushed plate 315 is mounted to one surface of the to-be-held plate 313 on the side opposite to the other surface facing the cylinder body 311. This to-be-pushed plate 315 serves as a portion to be pressed by a pushing plate 532 of the pushing part 53 of the mounting device 5, as mentioned later.

A lower end of the cylinder body 311 is formed as a flange 316 having a rectangular shape in plan view. As mentioned later, the hydraulic cylinder 31*b* is mounted to the holder 36 of the sliding nozzle device 3 by attaching this flange 316 to the holder 36.

On the other hand, a lower end of the cylinder rod 312 is formed as a connection part 317 for allowing the cylinder rod 312 to be removably connected to the sliding metal frame 33 of the sliding nozzle device 3. After connecting the sliding metal frame 33 to this connection part 317, the cylinder rod 312 can be moved forwardly and backwardly to slide the sliding metal frame 33 with respect to the fixed metal frame 32.

A guide plate 318 is connected to the connection part 317. This guide plate 319 is configured to be moved forwardly and backwardly while being guided by a guide groove 319 provided on a side surface of the flange 316. This allows the connection part 317 to be moved forwardly and backwardly without rotation.

Figure 6A:
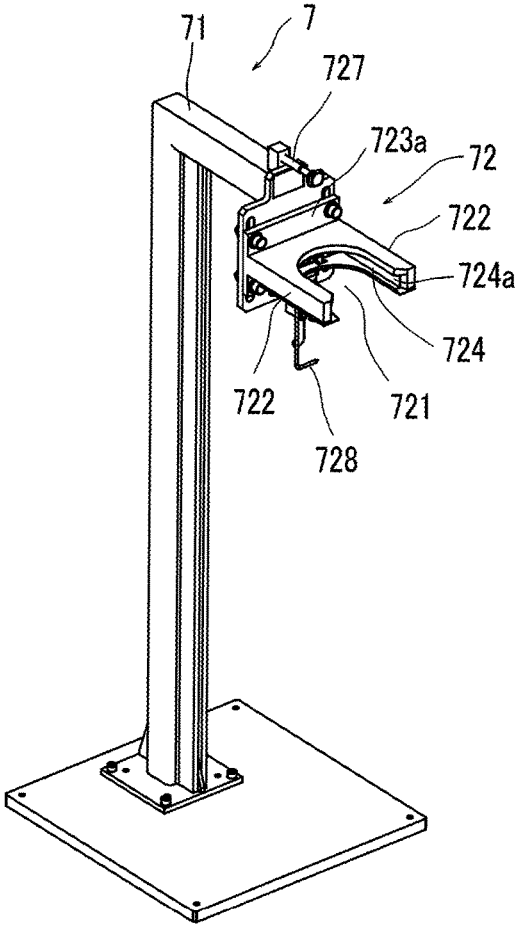
FIG. 6A is a perspective view of a stand.
Figure 8:
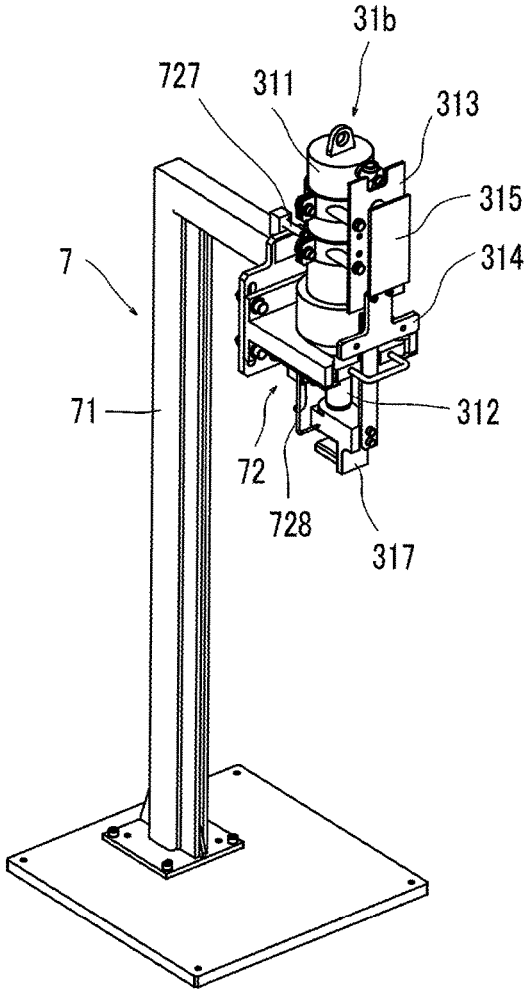
FIG. 8 is a perspective view showing a state in which the drive unit is loaded on the stand.
Figure 6B:
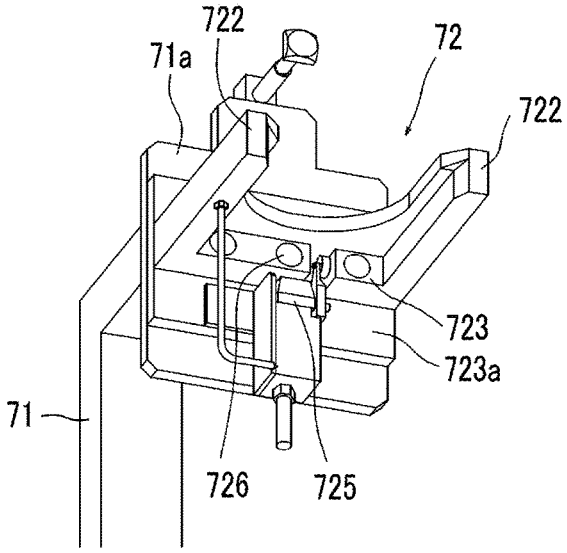

Next, the stand 7 will be described. FIGS. 6A, 6B and 7A-7C illustrate the stand 7. FIG. 6A and FIG. 6B are a perspective view and a fragmentary perspective view, respectively, and FIG. 7A, FIG. 7B, and FIG. 7C are a top plan view, a front view, and a right side view, respectively. Further, FIG. 8 illustrates a state in which the hydraulic cylinder 31*b* is loaded on the stand 7. It should be noted here that FIG. 6B is illustrated by omitting a lower portion of the after-mentioned pair of side walls 722.

The stand 7 comprises: a pillar 71 installed on the pedestal 23 in the maintenance site 2 illustrated in FIG. 1; a plate member 71*a* at an upper end of the pillar 71; and a loading rack 72 mounted to the plate member 71*a*.

The loading rack 72 comprises: an opening 721 into which the cylinder body 311 of the hydraulic cylinder 31*b* is to be inserted; a pair of side walls 722 defining the opening 721; and a back wall 723 coupling the pair of side walls 722 together. The back wall 723 has a platy surface portion 723*a* extending in an up-down direction. The loading rack 72 is fixed to the pillar 71 by fixing the platy surface portion 723*a* of the back wall 723 to the plate member 71*a* of the pillar 71 with bolts.

In this specification, mutually opposed surfaces of the pair of side walls 722 will be referred to as "inner surfaces of the pair of side walls 722". Further, a surface of the back wall 723 continuous with the inner surface of the pair of side walls 722 will be referred to as "inner surface of the back wall 723."

A pair of grooves 724 are provided on the inner surfaces of the pair of side walls 722, respectively. The flange 316 as the lower end the cylinder body 311 is inserted into the pair of grooves 724 to place the hydraulic cylinder 31*b* on the stand 7 (loading rack 72), as shown in FIG. 8. An inlet end of the pair of grooves 724 is formed as a taper area 724*a* gradually widening toward an inlet edge on the side opposite to the back wall 723. The presence of the taper area 724*a* facilitates the insertion of the flange 316.

A magnet 726 is provided on the inner surface of the back wall 723. Further, a groove is provided on the inner surface of the back wall 723, and a contact detection sensor 725 is inserted in the groove. The contact detection sensor 725 is configured to detect a contact with the flange 316 of the hydraulic cylinder 31*b*, and composed of, e.g., a limit switch. The magnet 726 makes it possible to bring the flange 316 of the hydraulic cylinder 31*b* into contact with the back wall 723 and hold the flange 316, by a magnetic force thereof in a reliable manner.

Further, a support bar 727 is provided just above the back wall 723. This support bar 727 is configured to, when the flange 316 of the hydraulic cylinder 31*b* is brought into contact with the back wall 723, contact the peripheral surface of the cylinder body 311 to prevent the cylinder body 311 from leaning.

An L-shaped stroke guide 728 is provided on a lower surface of one of the pair of side walls 722, such that it extends downwardly from the lower surface. The stroke guide 728 is configured to match the stroke of the cylinder rod 312 of the hydraulic cylinder 31*b* to a strike at an intermediate position. The term "strike at an intermediate position" here means the position of the cylinder rod 312 when respective through-holes of the upper plate 35*a* and the lower plate 35*b* each received in a respective one of the fixed metal frame and the sliding metal frame are aligned with each other.

The stroke guide 728 is used, for example, when a maintenance operation includes a step of demounting the hydraulic cylinder once in a state in which the through-holes of the upper plate 35*a* and the lower plate 35*b* are aligned with each other. In this process, the cylinder rod 312 of the detached hydraulic cylinder 31*b* can be displaced from the intermediate position due to its own weight. Even in this situation, the position of the lower edge of the connection part 317 can be aligned to the position of the lower edge of the stroke guide 728 to match the stroke of the cylinder rod 312 to the intermediate position.

Next, the details of the sliding nozzle device 3 will be described. As appearing in FIGS. 2A and 2C, on the basis of a state during use, in which the sliding direction of the sliding metal frame 33 extends horizontally, the sliding nozzle device 3 is provided with a shielding plate 37*a* on the side of a lower surface of the sliding metal frame 33 to protect the sliding metal frame 33 from splash, heat, etc., of molten steel during use. Similarly, a shielding plate 37*b* is provided on the side of a lower surface of each of the spring boxes 34, and a shielding plate 37*c* is provided on the side of a lower surface of the holder 36 (see FIG. 1) to which the hydraulic cylinder 31*a* or 31*b* is to be mounted.

Figure 9:
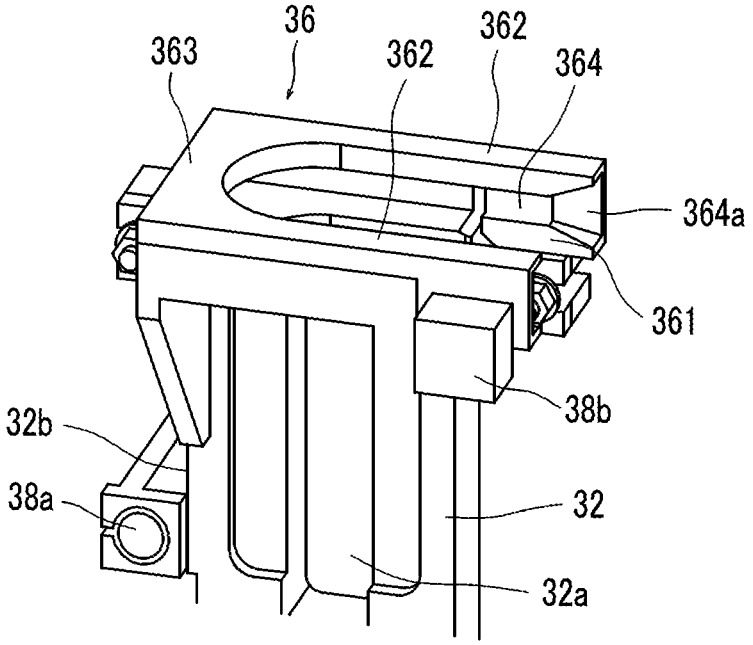
FIG. 9 is a perspective view showing a holder of the sliding nozzle device.

FIG. 9 illustrates the holder 36 in a state in which the shielding plate 37*c* is removed.

The holder 36 is mounted to an upper end of the fixed metal frame 32, and comprises an opening 361 into which the cylinder body 311 of the hydraulic cylinder 31*b* is to be inserted; a pair of side walls 362 defining the opening 361; and a back wall 363 coupling the pair of side walls 362 together.

In this specification, mutually opposed surfaces of the pair of side walls 362 will be referred to as "inner surfaces of the pair of side walls 362".

A pair of grooves 364 are provided on the inner surfaces of the pair of side walls 362, respectively. The flange 316 as the lower end the cylinder body 311 is inserted into the pair of grooves 362 to mount the hydraulic cylinder 31*b* to the holder 34, as shown in, e.g., FIG. 2A. An inlet end of the pair of grooves 364 is formed as a taper area 364*a* gradually widening toward an inlet edge on the side opposite to the back wall 363.

As appearing in FIG. 2A, the sliding nozzle device 3 is provided with four mark blocks 38*a* to 38*d* for allowing a maintenance robot to recognize the position thereof. In the embodiment, the maintenance robot is composed of the robot arm 4 comprising the mounting device 5, and is thus equipped with the laser irradiator 57 and the camera 58.

Among the four mark blocks 38*a* to 38*d*, the mark block 38*a* is provided on the fixed metal frame 32 for allowing the maintenance robot to recognize the position of the sliding nozzle device 3. Since the position of the fixed metal frame 32 does not change in the sliding nozzle device 3, the maintenance robot can figure out the position of the sliding nozzle device 3 by recognizing the position of the mark block 38*a*.

In this embodiment, in order to allow the maintenance robot to recognize the position of the sliding nozzle device 3, first of all, the mark block 38*a* is irradiated with laser light from the laser irradiator 57. Then, the position of the mark block 38*a* is determined from images taken by the camera 58 and indicting the shape of the laser light irradiating the mark block 38*a*, the position of the light on the mark block 38*a*, the intensity of the light on the mark block 38*a*, etc.

Such positional recognition of the sliding nozzle device 3 by the maintenance robot is performed in the maintenance site under the condition that the sliding nozzle device 3 is placed to stand vertically, and the sliding metal frame 33 is closed, as shown in FIG. 2A. In the sliding nozzle device, the mark block 38*a* is provided to protrude from a side surface or bottom surface of the fixed metal frame 32 toward the sliding metal frame 33. Further, the mark block 38*a* is provided at a position free from interference with the sliding metal frame 33 during sliding. This makes it possible to reliably and accurately recognize the mark block 38*a*, and avoid hindering a sliding movement of the sliding metal frame 33.

In this embodiment, the position free from interference between the mark block 38*a* and the sliding metal frame 33 means a position outside the sliding range in which the sliding metal frame 33 is slid during use and during maintenance. Particularly in this embodiment, the mark block 38*a* may be located closer to the holder 36 than the position of the head of the sliding metal frame 33 during maintenance. Alternatively, the mark block 38*a* may be located above a lower edge of a groove 32*a* of the fixed metal frame 32 at which the head of the hydraulic cylinder 31*b* and the head of the sliding metal frame 33 are located.

As mentioned above, the sliding nozzle device 3 in this embodiment uses the hydraulic cylinder 31*a* during use. The hydraulic cylinder 31*a* is used to slide the sliding metal frame 33 within the first sliding range under the condition that a surface pressure is loaded between the fixed metal frame 32 and the sliding metal frame 33. On the other hand, during maintenance, the hydraulic cylinder 31*b* is used to slide the sliding metal frame 33 to the outside of the first sliding range, thereby unloading the surface pressure.

Thus, the mark block 38*a* is preferably positioned such that it is covered by the sliding metal frame 33 or the shielding plate 37*a* provided to the sliding metal frame 33, when the sliding metal frame 33 is slid within the first sliding range during use, as shown in FIG. 2C. Further, the mark block 38*a* is preferably positioned such that it is not covered by the sliding metal frame 33 or the shielding plate 37*a*, when the sliding metal frame 33 is slid to the outside of the first sliding range, as shown in FIG. 2A. This makes it possible to protect the mark block 38*a* from splash, heat, etc., of molten steel during use, In order to protect the mark block 38*a* from heat, dust, etc., air for cooling springs in the spring boxes 34 may be diverted to blow air to the mark block 38*a*. Further, the mark block 38*a* may be brushed according to the sliding movement of the sliding metal frame 33.

The preferred position of the mark block 38*a* as mentioned above is typically around the upper end of the fixed metal frame 32, as shown in FIG. 2A. That is, this position of the mark block 38*a* is adjacent to the holder 36, as shown in FIG. 9. The holder 36 is opened in one direction orthogonal to the sliding direction of the sliding metal frame 33, and the hydraulic cylinder 31*b* is mounted/demounted through the opening oriented in the one direction. Thus, the mark block 38*a* is preferably disposed on the side of the holder opposite to the opening oriented in the one direction, as shown in FIG. 9. This makes it possible to avoid a situation where the mark block 38*a* hinders an operation of mounting/demounting the hydraulic cylinder 31*b*.

As shown in FIGS. 2A and 9, in this embodiment, a side wall of the fixed metal frame 32 partly has a protruding thick-walled portion 32*b*. The mark block 38*a* is mounted to the thick-walled portion 32*b* of the side wall of the fixed metal frame 32. A lower edge of the thick-walled portion 32*b* is flush with the lower edge of the groove 32*a* of the fixed metal frame 32. As long as the mark block 38*a* is located above the lower edge of the groove 32*a* of the fixed metal frame 32, it never overlaps the sliding metal frame 33.

On the other hand, the mark block 38*b* is provided on one of the side walls 362 of the holder 36 for allowing the maintenance robot to recognize the position of the holder 36. When mounting/demounting the hydraulic cylinder 31*b* to the holder 36, the positional recognition is performed as needed.

The mark block 38*c* is provided on a handgrip 341 to be operated when opening/closing the spring boxes 34. When opening/closing the spring boxes 34, the positional recognition is performed as needed.

The mark block 38*d* is provided on a handgrip 331 to be operated when opening/closing the sliding metal frame 33. When opening/closing the sliding metal frame 33, the positional recognition is performed as needed.

These mark blocks 38*a* to 38*d* are arranged in a positional relationship in which each of them is close to the next operating point of the maintenance robot. Further, each of the mark blocks 38*a* to 38*d* is made of a heat-resistant material such as iron or ceramic.

Next, the detailed configuration of each component of the mounting device 5 will be described.

Figure 10A:
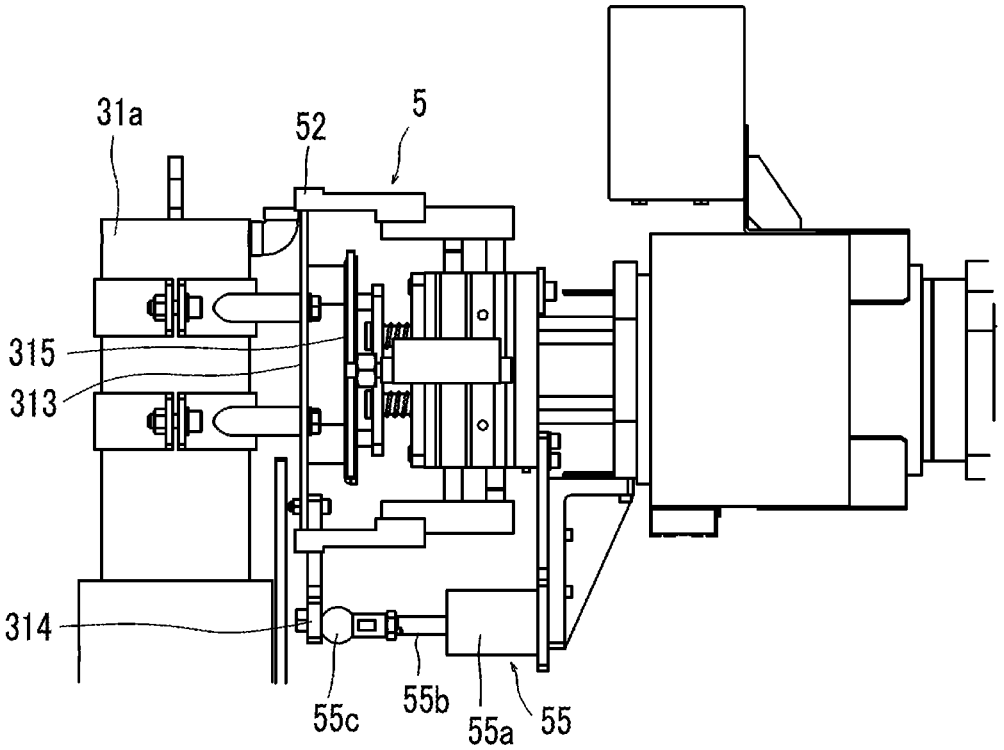
FIG. 10A is a front view showing a state in which the mounting device holds the drive unit (wherein a contact part is located at a first position).
Figure 10B:
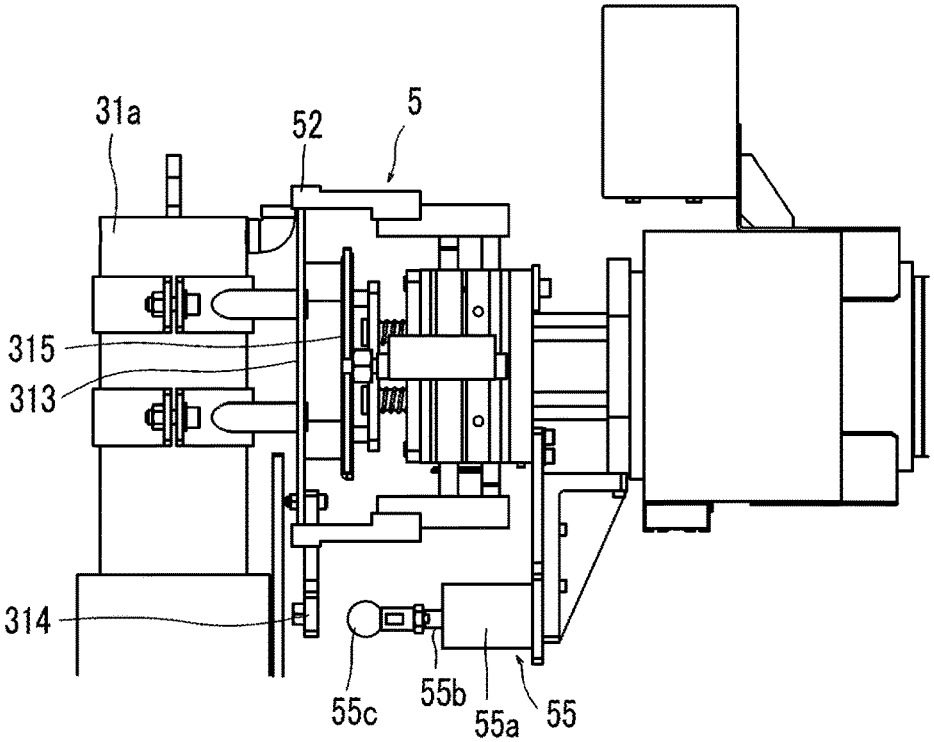
FIG. 10B is a front view showing a state in which the mounting device holds the drive unit (wherein the contact part is located at a second position).

FIGS. 10A and 10B illustrate a state in which the mounting device 5 holds the hydraulic cylinder 31*b*. Referring to FIGS. 10A and 10B together with FIGS. 3 and 4, the detailed configuration of each component of the mounting device 5 will be described.

As shown in FIGS. 3 and 4, a distal end of each of the holding parts 52 has an engagement groove 521. When clamping the to-be-held plate 313 by the two pairs of holding parts 52, the four engagement grooves 521 can receive four corners of the to-be-held plate 313, respectively.

Then, the parallel hands 51 are narrowed by the widening-narrowing means to hold the four corners of the to-be-held plate 313 of the hydraulic cylinders 31*b* by the four holding parts 52, respectively. The mounting device 5 is configured such that in the clamped state, a gap of 5 mm is ensured between the to-be-held plate 313 and an inner surface of each of the engagement grooves 521, in each of a longitudinal direction, a width direction and a thickness direction of the to-be-held plate 313. The gap provided in this manner allows the to-be-held plate 313 to be freely moved within the gap in the longitudinal, width and thickness directions of the to-be-held plate 313.

Here, means to hold the to-be-held plate 313 is not limited to the parallel hands 51 in this embodiment. For example, parallel chucks may be used. Further, means to hold the to-be-held plate 313 is not necessarily limited to the configuration in which the widening or narrowing is attained while the pair of holding parts 52 are maintained parallel to each other. For example, it is possible to employ a configuration in which the distance between the distal ends of the pair of holding parts is widened or narrowed by swinging movement of the pair of holding parts about respective base ends thereof.

In the pushing part 53, seven bolts 533 are fixed to a base plate 535 while penetrating through seven through-holes 531 of a holding plate 531 and seven coil springs 534, respectively, as shown in FIG. 4. This base plate 535 is mounted to the device body 512 of the parallel hands 51. The holding plate 531 holds the pushing plate 532 with a gap therebetween. Then, the pushing plate 532 is configured to be movable toward the base plate 535 while compressedly deforming the coil springs 534. Each of the through-holes provided in the holding plate 531 is greater than the diameter of each of the bolts 533. Thus, there is a gap between each of the through-holes of the holding plate 531 and a corresponding one of the bolts 533, so that the pushing plate 532 can take an inclined posture. In doing this way, even if the hydraulic cylinder 31*b* inclines when the mounting device 5 mounts the hydraulic cylinder 31*b* to the holder 36, the pushing plate 532 can incline in response to an inclination of the hydraulic cylinder 31*b* to maintain a surface contact state between the pushing plate 532 and the to-be-pushed plate 315.

The position of the pushing plate 532 is set at a position where the pushing plate 532 can hit against the to-be-pushed plate 315 when the to-be-held plate 313 of the hydraulic cylinder 31*b* is held by the holding parts 52 (engagement grooves 521). As a result, the coil springs 534 are compressedly deformed, and the to-be-held plate 313 is pressed against an inner wall surface of each of the engagement grooves 521 in a region on the side of the cylinder body 311.

The force sensor 54 is mounted to the flange 541 located on the side opposite to the pushing part 53 of the device body 512 of the parallel hands, with bolts. That is, in this embodiment, the force sensor 54 is configured to detect a force which is received by the holding parts 52 and the pushing part 53 from the hydraulic cylinder 31*b*. As such a force sensor configured to detect a force, a sensor referred to as "haptic sensor" and generally used for robot arms may be used. In this embodiment, a six-axis force sensor is used as the force sensor 54. In this embodiment, the force sensor 54 is coupled to the camera 58 through a bracket 542.

The pressing mechanism 55 comprises a pressing mechanism body 55*a*, a moving part 55*b* coupled to the mechanism body 55*a*, and a spherical contact part 55*c* provided at a distal end of the moving part 55*b*. This pressing mechanism 55 is provided on an attachment plate 513 extending downwardly from the device body 512 of the mounting device 5. In this embodiment, the pressing mechanism 55 is provided by a number of two, wherein the two pressing mechanisms 55 are disposed below the holding parts 52. The moving part 55*b* is provided such that it is extendable and retractable with respect to one end of the pressing mechanism body 55*a*. The moving part 55*b* extends forwardly from the one end of the pressing mechanism body 55*a*. Here, the forward side of the one end of the pressing mechanism body 55*a* means a direction toward the hydraulic cylinder 31*b*.

As shown in FIG. 10A, the contact part 55*c* is configured to be displaceable between a first position where the contact part 55*c* is in contact with the to-be-contacted part 314 which is the lower portion of the hydraulic cylinder 31*b*, as shown in FIG. 10A, and a second position where the contact part 55*c* is not in contact with the to-be-contacted part 314, as shown in FIG. 10B. This displacement is realized by extension and retraction movements of the moving part 55*b*. Specifically, the pressing mechanism 55 comprises a drive mechanism such as an air cylinder with a solenoid air valve, provided inside the pressing mechanism body 55*a*, although not illustrated. The extension and retraction of the moving part 55*b* can be controlled by electrically controlling the drive mechanism. Further, the electrical control of the drive mechanism also allows the extension and retraction movements of the moving part 55*b* to interlock with the holding movement of the holding parts 52 of the mounting device 5 and the movement of the robot arm 4.

In this embodiment, the two pressing mechanisms 55 are provided at respective positions which are bilaterally symmetric about a vertical central axis of the mounting device 5.

As shown in FIG. 4, comprises: a vibration mechanism body 56*a* provided on a lateral surface of the device body 512 of the mounting device 5; and a vibration part 56*b* provided at a distal end of the vibration mechanism body 56*a*. In this embodiment, the vibration mechanism 56 is provided by a number of two, wherein the two vibration mechanisms 56 are provided, respectively, on right and left ends of the pushing plate 532 of the mounting device 5. Alternatively, the vibration mechanism 56 may be provided on only one of the right and left ends of the pushing plate 532 of the mounting device 5. The vibration mechanism body 56*a* is internally provided with a non-illustrated vibratory device such as a vibration motor. The vibratory device is configured such that starting and stopping vibration can be electrically controlled. The vibration mechanism body 56*a* is vibrated by vibrating the vibratory device. The vibration of the vibration mechanism body 56*a* is transmitted to the vibration part 56*b*. The vibration part 56*b* is in contact with a back surface of the pushing part 53, so that it can transmit vibration to the pushing part 53. A vibration direction of the vibration mechanism body 56*a* may be set in a direction parallel to the pushing part 53. However, in this case, there is a possibility that the vibration part 56*b* is displaced in the vibration direction, leading to a change in a position where vibration is to be transmitted to the pushing part 53. Thus, the vibration direction is preferably set in a direction orthogonal to the pushing part 53.

The vibration mechanism body 56*a* is vibrated as needed when the pushing part 53 of the mounting device 5 pushes the to-be-pushed plate 315 of the hydraulic cylinder 31*b*. This vibration is transmitted from the vibration part 56*b* to the hydraulic cylinder 31*b* via the pushing part 53. In other words, the hydraulic cylinder 31*b* can be vibrated by vibrating the vibration mechanism body 56*a*.

Next, operation of the mounting device 5 will be described.

In the maintenance site 2, the mounting device 5 mounted at the distal end of the robot arm 4 is located at an origin position illustrated in FIG. 1. Although the sliding nozzle device 3 is mounted to the bottom 11 of the ladle just after completion of casting, the hydraulic cylinder 31*a* for use during use is demounted in the casting site, as mentioned above, and thus no drive unit is mounted to the holder 36 of the sliding nozzle device 3 in the maintenance site, as shown in FIG. 1. On the other hand, the hydraulic cylinder 31*b* for use during maintenance is loaded on the stand 7 in the hanging state. The mounting device 5 mounts the hydraulic cylinder 31*b* to the holder 36 of the sliding nozzle device 3, while allowing the hydraulic cylinder 31*b* to remain in the hanging state. The steps of the mounting operation are as follows. All the after-mentioned movements of the mounting device 5 are based on movements of the robot arm 4. However, in the following description, such movements will be described as movements of the mounting device 5 itself, for ease of explanation.

The mounting device 5 moves from the origin position illustrated in FIG. 1 to a position in front of the sliding nozzle device 3 mounted to the bottom 11 of the ladle. This first frontal position is preliminarily taught to the robot arm 4.

In the first frontal position, the mounting device emits laser light from the laser irradiator 57 toward the mark block 38*a*. Then, the position of the mark block 38*a* is determined from images taken by the camera 58 and indicating the shape of the laser light irradiating the mark block 38*a*, the position of the light on the mark block 38*a*, the intensity of the light on the mark block 38*a*, etc. When the determined position of the mark block 38*a* is different from a preliminarily-stored position of the mark block 38*a*, the mounting device 5 calculates a deviation distance between the determined position of the mark block 38*a* and the preliminarily-stored position of the mark block 38*a*. Then, the mounting device 5 calculates a corrected position of the mark block 38*a*, i.e., the sliding nozzle device 3. Further, the mounting device 5 writes the corrected position of the sliding nozzle device 3 over the preliminarily-stored position.

Subsequently, the mounting device 5 moves to a holding position of the hydraulic cylinder 31*b* loaded on the stand 7. This holding position means a position where the to-be-held plate 313 of the hydraulic cylinder 31*b* is held by the holding parts 52 of the mounting device 5. This holding position is also preliminarily taught by the robot arm 4. At the time when the mounting device 5 has arrived at the holding position, the distance between the parallel hands 51 of the mounting device 5 is widened more than an up-down directional length of the to-be-held plate 313. Then, after the mounting device 5 has arrived at the holding position, the distance between the parallel hands 51 of the mounting device 5 is narrowed to clamp the to-be-held plate 313. In this way, the to-be-held plate 313 of the hydraulic cylinder 31*b* is held by the holding parts 52 of the mounting device 5, Subsequently, the mounting device 5 moves horizontally and rearwardly. According to this movement, the flange 316 of the hydraulic cylinder 31*b* is pulled out of the pair of grooves 364 of the stand 7, so that the hydraulic cylinder 31*b* is released from the stand 7 while remaining in the hanging state.

Subsequently, the mounting device 5 moves to a position in front of the holder 36 of the sliding nozzle device 3, while holding the hydraulic cylinder 31*b* being in the hanging state. This second frontal position means a position where the hydraulic cylinder 31*b* is just before being brought into contact with the pair of side walls 362 defining the opening 361 of the holder 36. At the time when the mounting device 5 has arrived at the second frontal position, the contact part 55*c* of the mounting device 5 is located at the second position where the contact part 55*c* is not in contact with the to-be-contacted part 314 as the lower portion of the hydraulic cylinder 31*b*. This second frontal position is also preliminarily taught to the robot arm 4.

Subsequently, the mounting device 5 moves horizontally and forwardly to a contact position where the hydraulic cylinder 31*b* is brought into contact with the pair of side walls 362 defining the opening 361 of the holder 36. Then, when the mounting device 5 has arrived at this contact position, the contact part 55*c* of the mounting device 5 is displaced to the first position where the contact part 55*c* is in contact with the to-be-contacted part 314 as the lower portion of the hydraulic cylinder 31*b*, as shown in FIG. 10A. This contact position is also preliminarily taught to the robot arm 4. As used in this embodiment, the term "contact position" means a position where a corner of the flange 316 of the hydraulic cylinder 31*b* arrives at and comes into contact with the taper area 364*a* at the inlet end of the pair of grooves 364 formed on the pair of side walls 362 of the holder 36.

Figure 11:
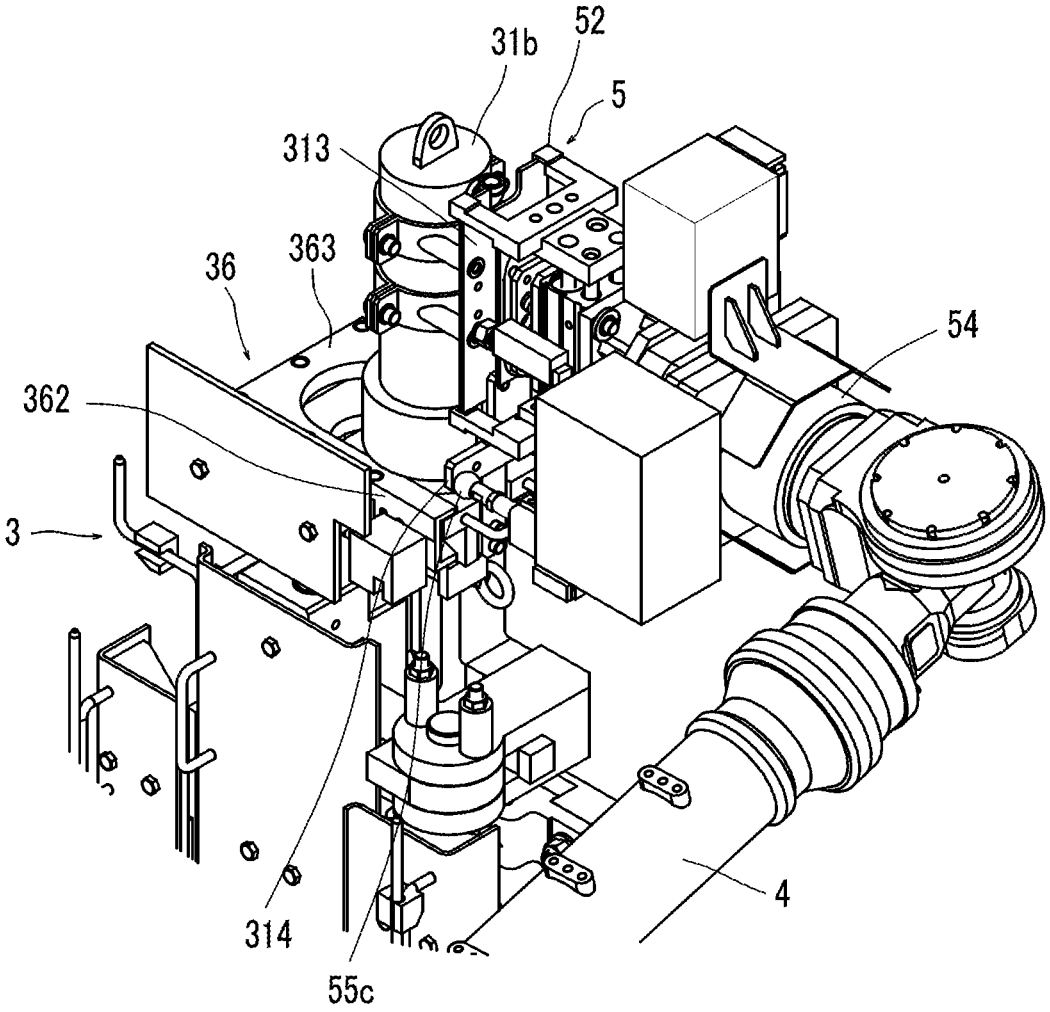
FIG. 11 is a perspective view showing a state during a course in which the mounting device holding the drive unit mounts the drive unit to the holder of the sliding nozzle device.

The mounting device 5 further moves from the contact position horizontally and forwardly. Thus, the flange 316 of the hydraulic cylinder 31*b* is inserted into the pair of grooves 364 formed on the pair of side walls 362 of the holder 36, and moved toward the back wall 363 of the holder 36 while being guided by the pair of grooves 364 (see FIG. 11).

Figure 12:
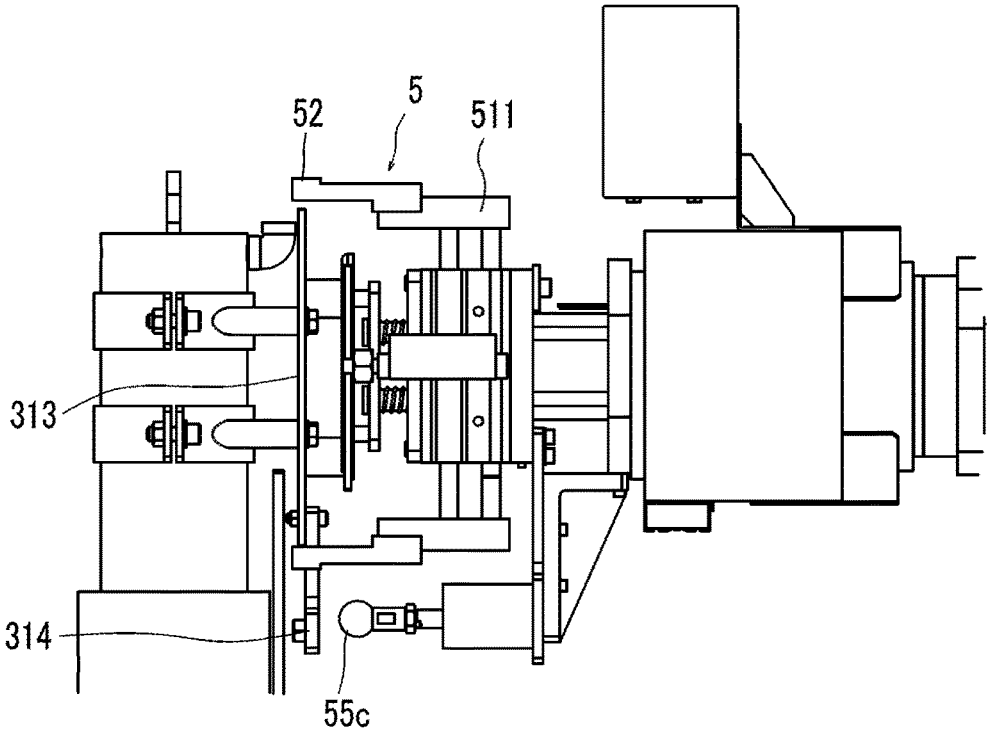
FIG. 12 is a front view showing a state in which the mounting device releases the drive unit.

During this movement, the pushing plate 532 of the pushing part 53 of the mounting device 5 is in contact with the to-be-pushed plate 315 of the hydraulic cylinder 31*b*. Thus, the holding parts 52 and/or the pushing part 53 receive a force from the hydraulic cylinder 31*b* as a reaction force, and this force is detected by the forcer sensor 54. Then, when the force detected by the force sensor 54 reaches a given threshold (e.g., 500 N), the hydraulic cylinder 31*b* is released from the holding parts 52 of the mounting device 5. This is because it can be regarded that the flange 316 of the hydraulic cylinder 31*b* has arrived at the back wall 363 of the holder 36, and the mounting operation for the hydraulic cylinder 31*b* has been completed. Specifically, when the force detected by the force sensor 54 reaches a given threshold, about 500 N, the parallel hands 51 of the mounting device 5 are widened as illustrated in FIG. 12 to release the hydraulic cylinder 31*b* from the holding parts 52 of the mounting device 5. Simultaneously, the contact part 55*c* is displaced to the second position where the contact part 55*c* is not in contact with the to-be-contacted part 314 as the lower portion of the hydraulic cylinder 31*b*.

As mentioned above, the mounting device 5 comprises the holding parts 52 for holding the to-be-held plate 313 mounted to the upper or central portion of the hydraulic cylinder 31*b*, and the contact part 55*c* which is contactable with the to-be-contacted part 314 as the lower portion of the hydraulic cylinder 31*b*, when the hydraulic cylinder 31*b* is mounted to the holder 36. Thus, the hydraulic cylinder 31*b* being in the hanging state can be smoothly mounted to the holder 36 of the sliding nozzle device 3, using the robot arm 4. Specifically, in a conventional mounting device, when trying to mount the hydraulic cylinder 31*b* being in the hanging state to the holder 36, while holding the upper or central portion of the hydraulic cylinder 31*b*, the lower portion of the hydraulic cylinder 31*b* being free is liable to become unstable particularly during mounting to the holder 36, resulting in failing to smoothly mount the hydraulic cylinder 31*b* to the holder 36. In contrast, the mounting device 5 according to this embodiment is configured such that the contact portion 55*c* is in contact with the to-be-contacted part 314 as the lower portion of the hydraulic cylinder 31*b*, during mounting to the holder 36, so that the hydraulic cylinder 31*b* being in the hanging state can be smoothly mounted to the holder 36.

In order to sufficiently attain the advantageous effect of the contact part 55*c*, the contact part 55*c* is preferably located at the first position at least when the hydraulic cylinder 31*b* is located between a position where the hydraulic cylinder 31*b* comes into contact with the pair of side walls 362 of the holder 36 and a position where the hydraulic cylinder 31*b* comes into contact with the back wall 363 of the holder 36, as in the above embodiment.

Further, in this embodiment, when the force detected by the force sensor 54 reaches a given threshold during mounting of the hydraulic cylinder 31*b* to the holder 36, the holding parts 52 release the hydraulic cylinder 31*b*, so that the mounting of the hydraulic cylinder 31*b* can be reliably performed.

In this embodiment, the holding parts 52 are configured to release the hydraulic cylinder 31*b* when the force detected by the force sensor 54 reaches a given threshold during mounting of the hydraulic cylinder 31*b* to the holder 36, i.e., at the time when the mounting of the hydraulic cylinder 31*b* is completed. Alternatively, the holding parts 52 may be configured to release the hydraulic cylinder 31*b* in the course of the mounting of the hydraulic cylinder 31*b* to the holder 36. In this case, after release of the hydraulic cylinder 31*b*, the pushing part 53 receives a force from the hydraulic cylinder 31*b* as a reaction force, and this force is detected by the force sensor 54. Then when the force detected by the force sensor 54 reaches a given threshold, the holding parts 52 cease the mounting operation. This also can reliably perform the mounting of the hydraulic cylinder 31*b*.

After completion of the mounting of the hydraulic cylinder 31*b*, the mounting device moves to the origin position illustrated in FIG. 1.

When demounting the hydraulic cylinder 31*b* from the holder 36, the hydraulic cylinder 31*b* moves to a position in front of the hydraulic cylinder 31*b*, and after holding the hydraulic cylinder 31*b*, moves horizontally and rearwardly. In this way, the hydraulic cylinder 31*b* is demounted from the holder 36. Then, the mounting device 5 moves to a position in front of the stand 7, while holding the hydraulic cylinder 31*b*. Subsequently, the mounting device 5 moves horizontally and forwardly from the position in front of the stand 7. Thus, the flange 316 as the lower end of the cylinder body 311 is inserted into the pair of grooves 724 formed on the pair of side walls 722 of the stand 7, and moved toward the back wall 723 of the stand 7, while being guided by the pair of grooves 724. Then when the contact detection sensor 725 detects a contact of the flange 316 of the hydraulic cylinder 31*b*, the mounting device 5 widens the parallel hands of the mounting device 5. In this way, the hydraulic cylinder 31*b* is released from the holding parts 52 of the mounting device 5. As a result, the hydraulic cylinder 31*b* is loaded on the stand 7. After completion of the loading of the hydraulic cylinder 31*b*, the mounting device 5 moves to the origin position illustrated in FIG. 1.

It should be noted that when demounting the hydraulic cylinder 31*b* from the holder 36, the hydraulic cylinder 31*b* is also in the hanging state. The above positions during the demounting operation are also preliminarily taught to the robot arm 4.

LIST OF REFERENCE SIGNS

1: ladle
11: bottom of ladle
2; maintenance site
21: floor of maintenance site
22: ladle cradle
23: pedestal
3: sliding nozzle device
31*a*, 31*b*: hydraulic cylinder (drive unit))
311: cylinder body
312: cylinder rod
313: to-be-held plate
314: to-be-contacted part
315: to-be-pushed plate
316: flange
317: connection part
318: guide plate
319: guide groove
32: fixed metal frame
32*a*: groove of fixed metal frame
32*b*: thick-walled portion of fixed metal frame
321, 322: rotary shaft
33: sliding metal frame
331: handgrip
34: spring box
341: handgrip
35*a*: upper plate
35*b*: lower plate
36: holder
361: opening
362: side wall
363: back wall
364: groove
364*a*: taper area
37*a*, 37*b*, 37*c*: shielding plate
38*a*, 38*b*, 38*c*, 38*d*: mark block
4: robot arm (manipulator)
5: mounting device
51: parallel hand
511: parallel hook
512: device body
513: attachment plate
52: holding part
53: pushing part
531: holding plate
532: pushing plate
533: bolt

534: coil spring
535: base plate
54: force sensor
541: flange
542: bracket (heat-insulating cover)
55: pressing mechanism
56: vibration mechanism
56*a*: vibration mechanism body
56*b*: vibration part
57: laser irradiator
58: camera
6: suspending device
7: stand
71: pillar
71*a*: plate member of pillar
72: loading rack
721: opening
722: side wall
723: back wall
723*a*: platy surface portion of back wall
724: groove
724*a*: taper area
725: contact detection sensor
726: magnet
727: support bar
728: stroke guide

The invention claimed is:

1. A sliding nozzle device comprising: a fixed metal frame; and a sliding metal frame slidably provided to the fixed metal frame, wherein the fixed metal frame is provided with a mark block so that a maintenance robot can recognize a position of the mark block, the mark block being provided to protrude from a side surface or bottom surface of the fixed metal frame toward the sliding metal frame, at a position free from interference with the sliding metal frame during sliding, wherein a laser irradiator of the maintenance robot irradiates the mark block with laser light and a camera of the maintenance robot takes an image of the laser light irradiating the mark block so as to recognize the position of the fixed metal frame.

2. The sliding nozzle device as claimed in claim 1, which is configured to during use, slide the sliding metal frame within a first sliding range under a condition that a surface pressure is loaded between the fixed metal frame and the sliding metal frame, and during maintenance, slide the sliding metal frame to an outside of the first sliding range, thereby unloading the surface pressure, wherein the mark block is positioned such that it is covered by the sliding metal frame or a shielding plate provided to the sliding metal frame, when the sliding metal frame is slid within the first sliding range, but not covered by the sliding metal frame or the shielding plate, when the sliding metal frame is slid to the outside of the first sliding range.

* * * * *